United States Patent [19]

Ryan

[11] Patent Number: 4,987,422

[45] Date of Patent: Jan. 22, 1991

[54] CONCEALABLE VEHICULAR RADIO COMMUNICATIONS ANTENNA SYSTEM

[76] Inventor: Kevin M. Ryan, 22056 Viscanio Rd., Woodland Hills, Calif. 91364

[21] Appl. No.: 396,296

[22] Filed: Aug. 21, 1989

[51] Int. Cl.[5] ..... H01Q 1/32

[52] U.S. Cl. ..... 343/713; 343/714; 343/715; 343/888; 343/900

[58] Field of Search ..... 343/711–715, 343/901, 900, 903, 878, 888, 889; 439/916; 174/138 A, 152 A, 153 A

[56] References Cited

U.S. PATENT DOCUMENTS

| | | | |
|---|---|---|---|
| 2,313,321 | 3/1943 | Carlson et al. | 343/714 |
| 2,493,787 | 1/1950 | Torretti | 343/900 |
| 2,668,187 | 2/1954 | Von Wald et al. | 343/900 |
| 3,276,021 | 9/1966 | Horndasch | 343/715 |
| 3,873,985 | 3/1975 | Altmayer | 343/714 |

FOREIGN PATENT DOCUMENTS

| | | | |
|---|---|---|---|
| 2546260 | 4/1977 | Fed. Rep. of Germany | 343/715 |
| 1127480 | 12/1956 | France | 343/714 |

*Primary Examiner*—Michael C. Wimer
*Attorney, Agent, or Firm*—J. E. McTaggart

[57] ABSTRACT

For a vehicle which sometimes requires two-way radio communications but which sometimes requires an ordinary appearance, for example an unmarked law enforcement vehicle which could be compromised by the conspicuousness of a conventional communications antenna and associated external mounting hardware, this antenna system provides an external antenna rod which is readily deployable and removable from within the vehicle. The novel mounting hardware is highly inconspicuous since its exposed area is very small and is made flush with the surrounding vehicle body surface. In the mounting assembly, an insulated bushing, carrying a socket having a contact sleeve, has a small aperture in line with the contact sleeve, forming a passageway through the vehicle body through which the external antenna rod may be deployed. Alternatively, an internal antenna rod may be readily deployed in the same mounting assembly to project inwardly, enabling covert limited range communications. The internal antenna rod is fitted with a protective ball at the end to avoid risk of injury. The mounting assembly is easily installed in a vehicle, requiring only one small hole through the body.

11 Claims, 2 Drawing Sheets

Fig. 3
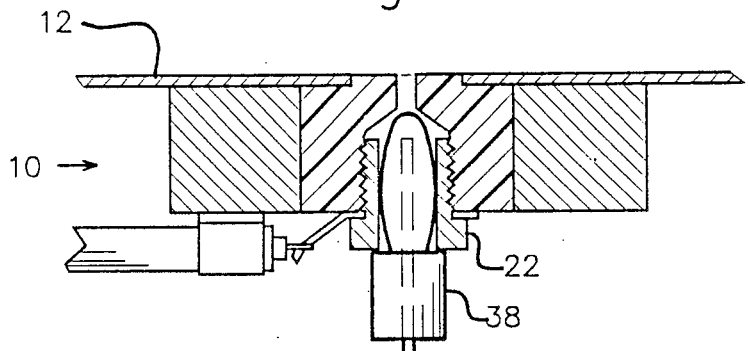
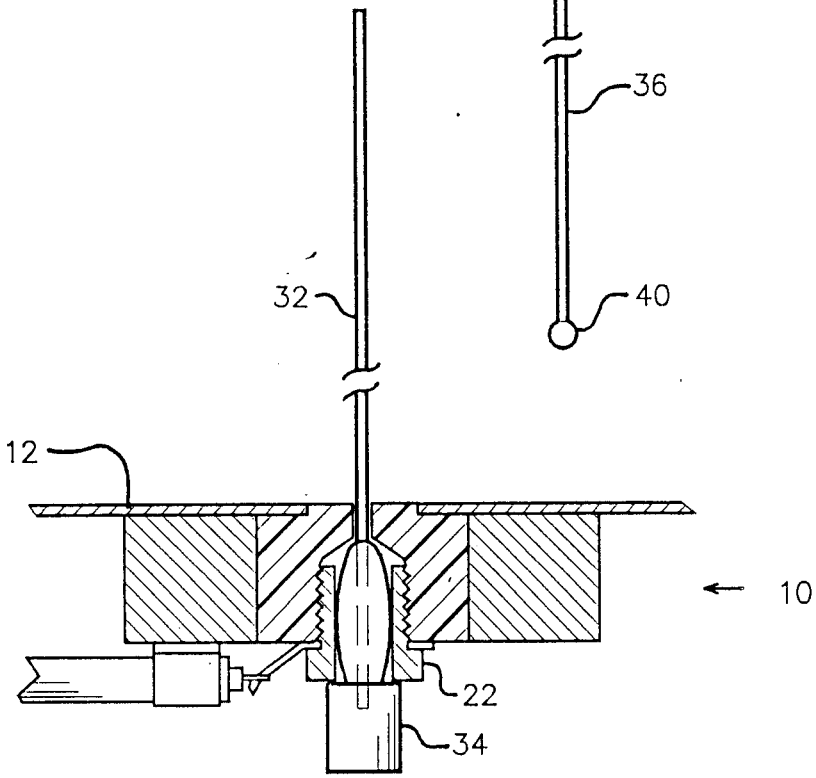
Fig. 2

CONCEALABLE VEHICULAR RADIO COMMUNICATIONS ANTENNA SYSTEM

FIELD OF THE INVENTION

The present invention, in the field of vehicular radio communications, relates to a vehicular antenna system in which an external rod element may be readily deployed or removed from within the vehicle, external visibility of mounting hardware is minimized, and an internal antenna mode is facilitated.

BACKGROUND OF THE INVENTION

Typically for vehicular communications a quarter wave vertical antenna rod is mounted vertically above a ground plane formed by a sheet metal body region, usually on rooftop or rear deck locations which have been found to provide efficient operation. Such an antenna may be considered unsightly when the vehicle is also used part time for private purposes. In unmarked law enforcement vehicles, high visibility of a conventional communications antenna and associated mounting hardware clearly poses a serious disadvantage. Conventional antenna mountings do not lend themselves to easy removal or concealment: either the antenna is not readily removable, or the mounting, which must be securely bonded to the metal car body for reasons of RF grounding integrity, may still leave telltale pieces of hardware exposed when the antenna rod is removed.

A transverse baseplate type antenna mounting assembly such as that disclosed in U.S. Pat. No. 4,184,160, which is secured in place by screw means, would be inconvenient to remove and replace, and would be bulky and awkward to store in the vehicle while removed.

Furthermore, it would be highly advantageous to be able to remove or conceal the antenna from within the vehicle; this is impossible in known antenna mounting configurations. Well known auto radio receiver antenna configurations of the retractable telescopic type are deemed unsuitable for two way radio communications purposes, and are generally conspicuous even when retracted.

With the regular antenna removed or concealed, there will usually be a need to conduct further communications; however this is normally impossible with the external antenna element removed.

It has been found empirically that an antenna located within vehicle, despite the partial shielding effect of the metal vehicle body, will radiate sufficiently through openings such as windows to provide useful communications despite some reduction in radiated field strength which limits the useable distance range. Known communication antenna mounting configurations fail to provide for deployment within the vehicle, and have otherwise generally failed to anticipate or address the problems which have been identified and solved by the present invention.

SUMMARY OF THE INVENTION

It is a primary object of the present invention to provide a vehicular communications antenna assembly in which an external antenna rod is readily removable from inside the vehicle.

It is a further object to configure an antenna mounting assembly which blends with the surrounding external area of the vehicle so as to be inconspicuous when the external rod is removed.

It is a further object of the invention to facilitate an internal antenna mode in the vehicle.

A still further object is that the antenna mounting be installable with minimal modification to the vehicle.

These objects have been achieved in the invention as illustrated in the accompanying drawings and described in the following text.

BRIEF DESCRIPTION OF THE DRAWINGS

FIG. 2 shows an external antenna rod deployed in the mounting assembly of FIG. 1.

FIG. 3 shows an internal antenna rod deployed in the mounting assembly of FIG. 1.

DETAILED DESCRIPTION

Figure 1A:
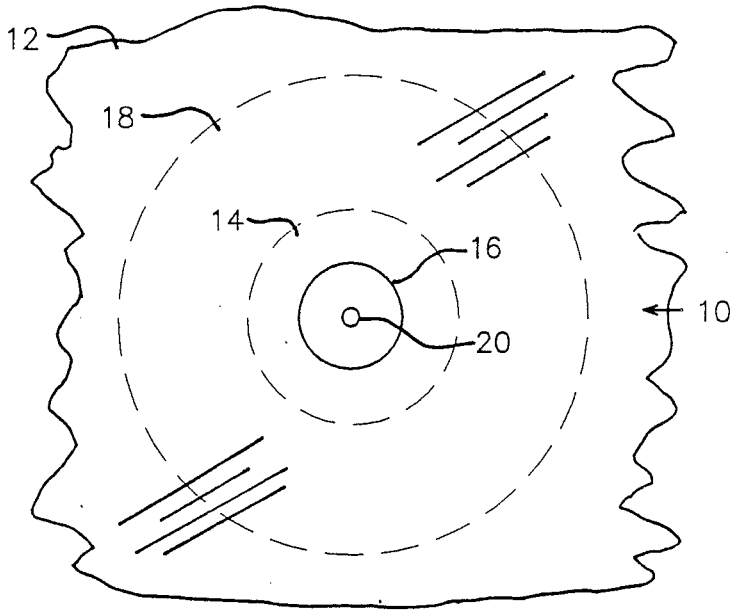
FIG. 1A is a top view of FIG. 1.
Figure 1:
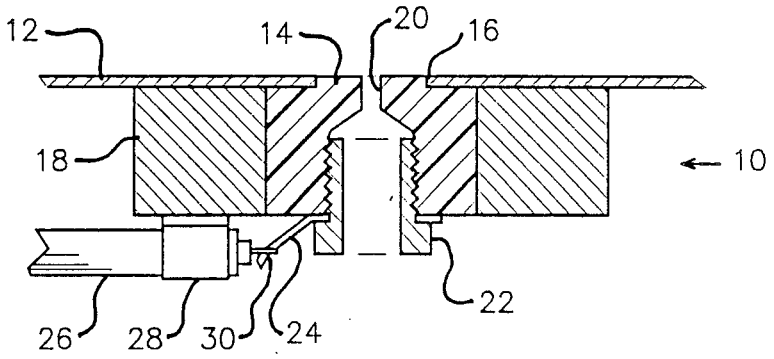
FIG. 1 is a cross sectional front view of an antenna mounting assembly, in accordance with the present invention, installed in a horizontal portion of a vehicle body.

In the cross sectional view of FIG. 1, an antenna mounting assembly 10 of the present invention in a preferred embodiment is shown installed in a horizontal sheet metal region 12 of a vehicle. A cylindrical insulting bushing 14 has an upper region of reduced diameter fitted into the perimeter 16 of a round mounting hole in region 12 of the sheet metal body of the vehicle.

The upper portion of bushing 14 is dimensioned to provide an upward surface flush with the upward surface of region 12 of the vehicle sheet metal body as shown. Bushing 14 is fitted in an interference fit within a cylindrical metal collar 18 and retained by staking. Collar 18 is adhesively affixed at its upward facing surface in conductive electrical contact against the downward facing surface of sheet metal body region 12.

Bushing 14 has through the center of its upper region a small cylindrical aperture 20, and coaxially beneath, a larger vertical cylindrical aperture, extending to its lower surface, into which is threaded a metal banana type socket 22 securing a contact lug 24. The contact sleeve inside socket 22 in combination with aperture 20 forms a passageway through the body region 12.

A coaxial cable 26, serving as the transmission line from the vehicle's communications transceiver (not shown) is secured to collar 18 by a clamp 28 to provide cable strain relief as well as ground contact to the outer sheath of cable 26. The inner conductor 30 of cable 26 is soldered or otherwise conductively attached to lug 24, thereby making electrical contact with the contact sleeve of socket 22.

FIG. 1A is a top view of FIG. 1 showing the vehicle sheet metal region 12 in which an antenna mount 10 is installed. Bushing 14 is made to fit closely within the mounting hole perimeter 16, flush with the surrounding sheet metal region 12, for minimal external visibility of the antenna mounting, which may be further enhanced by choosing a light or dark colored material in bushing 14 to blend in with the surrounding vehicle body 12; the collar 18 and main body of bushing 14 are fully concealed as indicated in dashed outlines and the aperture 20 is of small diameter: about 0.04".

FIG. 2 shows a vertical antenna rod 32 deployed in mounting assembly 10 (as in FIG. 1) by means of a banana plug 34, which mates with banana socket 22. Rod 32 is fitted into a central bore in plug 34 where it is mechanically secured and conductively bonded. Frictional insertion force between plug 34 and socket 22 holds rod 32 in place as shown and provides the necessary electrical contact for operation as a conventional vertical antenna. The length of rod 32 is typically made to correspond to ¼ wavelength at the operating frequency. The antenna rod 32 may be readily removed from inside the vehicle by grasping the body of banana plug 34 and thereby pulling rod 32 downward through aperture 20 into the vehicle, and is readily redeployed in the reverse manner.

FIG. 3 shows an internal rod antenna 36 having affixed at its upper end a banana plug 38 which is plugged into socket 22, providing electrical contact and mechanical support in the same manner as plug 34 (FIG. 2) except that rod 36 extends downward inside the vehicle. A ball 40, or equivalent protective means, is formed or affixed at the lower end of rod 36 to avoid bodily injury hazard. Rod 36 may be made the same length as rod 32 (FIG. 2) or shorter: optimal length, depending on particular vehicle features and radio operating frequency, may be determined empirically or estimated in a conventional manner.

In a preferred embodiment the rods 32 and 36 are of 0.04" diameter stainless steel, each silver soldered to the corresponding banana plug. Bushing 14 is molded in Delrin or equivalent dielectric material and is made 0.43" in outside diameter by 0.375" thick. The mounting hole 16 required in the vehicle body sheet metal region 12 is 0.1875" in diameter. Collar 18 is made from metal such as steel, aluminum or brass, 1" in outside diameter by 0.375" thick and its upper surface is bonded to the underside of vehicle sheet metal region 12 by two part conductive epoxy adhesive; to enhance bonding, the the upper surface of collar 18 is knurled in a cross hatch pattern. The dimensions indicated are estimated to produce impedance parameters suited to a 50 ohm nominal impedance of coaxial cable 28.

The conductive sheath of cable 28 should be soldered or otherwise conductively bonded to collar 18.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An antenna assembly, for vehicular radio communication, comprising;

an insulator, made in the form of a cylindrical bushing, secured to a downward facing surface of a body region of a vehicle, said insulator having (a) a through aperture disposed coaxially relative to an opening in the body region and (b) an upward facing surface, disposed within the opening, flush with an upward facing surface of the body region surrounding the opening;

a metallic collar, surrounding said insulator, adapted to secure said insulator to an inner surface of the vehicle body region;

a socket having a contact sleeve disposed coaxially within the aperture so as to form, in combination therewith, a passageway through the body region, said socket being substantially contained within the insulator and the sleeve being operationally connected to radio communication means in the vehicle; and antenna means having enlarged plug means engaging the socket sleeve, said antenna means being made readily deployable and fully removable from within the vehicle manually without the use of tools.

2. The antenna assembly as defined in claim 1 wherein said antenna means comprises an elongated metal rod, and wherein said plug means comprises a generally cylindrical coaxial spring-loaded banana-shaped contact portion attached to a lower end of said rod, engaging said socket sleeve in a manner to deploy said antenna means with said rod projecting upwardly from the vehicle thus enabling an external mode of antenna operation.

3. The antenna assembly as defined in claim 1 wherein said antenna means comprises an elongated metal rod, and wherein said plug means comprises a generally cylindrical coaxial spring-loaded banana-shaped contact portion, attached to an upper end of said rod, engaging said socket sleeve in a manner to deploy said antenna means with said rod projecting downwardly within the vehicle with no part of the antenna assembly extending above the upward facing surface of the surrounding body region, thus enabling a concealed internal mode of antenna operation.

4. The antenna assembly as defined in claim 3 wherein said antenna means further comprises at a lower end of said rod an enlarged portion for purposes of avoiding bodily injury.

5. The antenna assembly as defined in claim 1 wherein said radio communication means is connected to said antenna assembly through a coaxial transmission line having an outer sheath conductor connected to said metallic collar and an inner conductor connected to said socket sleeve.

6. The antenna assembly as defined in claim 5 further comprising a clamp adapted to secure an end of said coaxial transmission line to said collar, said collar being electrically bonded to the outer sheath conductor of the coaxial transmission line and to the vehicle body region.

7. A vehicular antenna assembly comprising:

an insulator, made in the form of a short flat cylindrical bushing, secured to a downward facing surface of a body region of a vehicle, having an upper portion shaped to fit within a circular opening in the body region so as to define an upward facing surface flush with a surrounding upward facing exterior surface of the vehicle body region;

a metallic collar attached to a downward facing surface of the vehicle body in a region surrounding said insulator, the collar securing said insulator relative to the vehicle body;

a socket having a hollow cylindrical contact sleeve disposed coaxially within an aperture traversing vertically through said insulator, the sleeve defining, in combination with the aperture, a passageway through the body region, said socket being substantially contained within the insulator, and the sleeve being operationally connected to radio communication means in the vehicle; and a rod antenna selected from a group of two comprising a first antenna having a plug, disposed at a lower end of said antenna, adapted to engage said socket in a manner to enable an external antenna mode, and a second antenna having a plug, disposed at an upper end of said antenna, adapted to engage said socket in a manner to enable an internal antenna mode.

8. The antenna assembly as defined in claim 7 further comprising a layer of conductive epoxy adhesive attaching said collar to the downward facing surface of the vehicle body.

9. An antenna assembly, for vehicular radio communication, comprising;

an insulator, secured to a downward facing surface of a vehicle body region surrounding an opening therein, said insulator having an upward facing surface, disposed within the opening, flush with an upward facing body surface surrounding the opening, and having an aperture traversing vertically through the insulator at a central location in the upward facing surface thereof;

a socket, secured to said insulator, having a contact sleeve disposed coaxially within the aperture so as to form, in combination therewith, a passageway through the vehicle body region, said socket being substantially contained within the insulator, the sleeve being operationally connected to radio communication means in the vehicle; and an antenna comprising an elongated metal rod having, attached coaxially at an end thereof, a plug of a banana type having (a) a generally cylindrical contact portion, of substantially greater diameter than the rod, spring loaded so as to manifest a compressible resilient diameter, and (b) attached coaxially at a lower end thereof, a cylindrical finger grip collar portion of substantially greater diameter than the contact portion.

10. The antenna assembly as defined in claim 9 wherein said plug is disposed at a lower end of said antenna so as to enable deployment as an external antenna from within a host vehicle.

11. The antenna assembly as defined in claim 9 wherein said plug is disposed at an upper end of said antenna so as to enable deployment as an internal antenna within a host vehicle.

* * * * *